United States Patent [19]

Schmidt et al.

[11] Patent Number: 5,029,755

[45] Date of Patent: Jul. 9, 1991

[54] PAINT COLOR CHANGE SYSTEM

[75] Inventors: Thomas D. Schmidt, Troy, Ohio; John D. Walker, Dearborn Heights; Douglas H. Juhl, Milford, both of Mich.

[73] Assignee: Motoman, Inc., Rochester Hills, Mich.

[21] Appl. No.: 479,138

[22] Filed: Feb. 12, 1990

[51] Int. Cl.[5] ..... B05D 7/00; B05B 15/08

[52] U.S. Cl. ..... 239/1; 239/305; 239/390; 239/587; 239/588; 901/43; 118/302

[58] Field of Search ..... 901/43; 239/390, 302, 239/303, 304, 305, 588, 1, 587; 118/302, 310, 322, 704

[56] References Cited

U.S. PATENT DOCUMENTS

| | | | |
|---|---|---|---|
| 3,674,205 | 7/1972 | Kock | 239/1 |
| 3,674,207 | 7/1972 | Carbonetti, Jr. et al. | 239/305 X |
| 4,378,959 | 4/1983 | Susnjara | 901/43 X |
| 4,630,567 | 12/1986 | Bambousek et al. | 118/323 |
| 4,726,528 | 2/1988 | Gaiotto et al. | 239/579 |
| 4,785,760 | 11/1988 | Tholome | 239/587 X |
| 4,864,966 | 9/1989 | Anderson et al. | 118/302 X |
| 4,944,459 | 7/1990 | Watanabe et al. | 901/43 X |

FOREIGN PATENT DOCUMENTS 60-36365 7/1980 Japan .

*Primary Examiner*—Andres Kashnikow
*Assistant Examiner*—Lesley D. Morris
*Attorney, Agent, or Firm*—Biebel & French

[57] ABSTRACT

A paint spraying system is disclosed for use with an automated robot having an elongated arm. The robot arm is pivoted at one end and has a spray gun attached to an opposite freely movable end. A bracket is attached to the robot arm for mounting a rigid pipe or wand thereto for conveying paint from a flexible paint supply hose to the spray gun. The wand is detachably mounted to the robot arm and a plurality of wands may be positioned on a rack within reach of the robot arm such that, upon predetermined movements of the robot arm, a wand mounted on the robot arm may be placed in the rack and another wand may be picked up, and wherein each wand is connected to a different paint color supply hose.

21 Claims, 5 Drawing Sheets

PAINT COLOR CHANGE SYSTEM

BACKGROUND OF THE INVENTION

The present invention relates to a spraying system, and more particularly, to a paint spraying system using a robot having a movable arm.

Paint spraying operations performed on workpieces moving along a conveyor, such as those used in automotive painting plants, have historically been performed manually. As a workpiece, such as an automobile body, moves along the conveyor, a worker carrying a spray gun would move the gun back and forth across the body while walking a short distance along the conveyor. Sufficient hose would be provided to enable the worker to freely the move spray gun and, in order to avoid the excess hose from striking the body being painted, the worker would grasp a portion of the hose with a free hand and hold it behind his or her back while spraying.

In a typical painting plant, the paint color being sprayed at any given paint station may be changed as much as once for every workpiece passing by on the conveyor. In past painting systems, in order to select the color to be sprayed, a rack was provided having a plurality of hoses, each one supplying a different paint color, and the worker could take a hose and connect it to the spray gun by means of a quick disconnect fitting. The worker would then spray a small amount of the new color of paint through the gun prior to spraying the workpiece in order to clear out any of the old paint remaining in the gun.

In an improved painting system, such as the one shown in U.S. Pat. No. 3,674,205, the worker was provided with a control panel by which a particular color could be selected by means of pneumatically or solenoid controlled valves which would supply the desired paint color from one of a plurality of paint supply hoses to a single inlet hose to the spray gun. In this system, in order to change the paint color, the inlet hose had to be purged with a solvent and refilled with a new paint color prior to spraying the workpiece such that the new color of paint was not contaminated with residual paint remaining in the hose and gun, which could lead to off-color workpieces.

In recent years, the spraying operation in painting plants has been automated through the use of robots. The robot typically has a spray gun mounted to the end of a pivoted arm with the spray gun and arm articulated for various degrees of movement. A central hose used to supply paint to the spray gun must be held in close contact to the arm in order to prevent the hose from whipping into the workpiece being painted as the spray gun is moved back and forth.

When it is desired to change the color being sprayed, a valve similar to that used for manual systems operates to switch between colors, however, as with the manual systems, before the new color can be sprayed, the central hose leading to the spray gun must be purged with a solvent to eliminate the old color in order to ensure that a mixed color is not sprayed. This clean-out operation is estimated to cost in excess of $140,000 per robot in solvent and lost paint per year.

In addition, in order to ensure that the paint being sprayed is a consistent color, a recirculatory line is provided from each of the individual paint supply lines for each color to keep the paint flowing within the supply line when the valve leading to the spray gun is closed. If the control valves should malfunction such that one color gets mixed within the recirculatory line of another color, the plant must be closed and the lines purged of any remaining paint in order to ensure that the proper colors will be supplied by the particular lines. This type of accident can be costly both in down time of the plant and in lost paint.

One solution to eliminating the waste of solvent and paint resulting from the problems described above is to provide a rack having a plurality of hoses such that the robot can select a given hose in order to spray a selected color. The Japanese published disclosure 60-36365 discloses such a solution for a painting system which uses a robot. In the Japanese system the robot selects an individual hose which is connected close to the sprayer and then uses the sprayer with the hose dangling freely downwardly. This system suffers from the problem of the long unrestrained hose being free to whip around as a robot arm moves the sprayer, such that the hose may contact the workpiece being sprayed. This problem is particularly severe if the robot is moved rapidly back and forth across the workpiece, as is typical in automated automotive painting operations.

Thus, there is a need for a paint spraying system using a robot in which the amount of paint lost during color changing operations is minimized as well as minimizing the possibility of accidental color mixing. In addition, there is a need for a paint spraying system in which the movement of a paint supply hose is properly controlled during movement of the robot in order to avoid any contact between the paint supply hose and the workpiece being painted.

SUMMARY OF THE INVENTION

The present invention is a paint spraying system for use with a robot having a movable elongated arm.

The system includes a plurality of paint wands which may be individually positioned on the arm of the robot, with each of the wands including a first elongated rigid pipe for conveying paint to a spray gun through a flexible wrist hose connecting the first pipe to the spray gun. A second elongated rigid pipe may be provided for recirculating paint from the first pipe when the wand is not in use and the second pipe may be either formed integrally with the first pipe or provided as a separate pipe oriented parallel to the first pipe.

First and second flexible hoses connect the first and second pipes to a paint source and a paint recirculation system, respectively. In addition, a first half of a quick disconnect fitting and a regulator valve may be provided for connecting the first pipe to the spray gun either at the end of the first pipe or at an end of the flexible wrist hose distal from the first pipe such that the wand may be quickly connected to the inlet of the spray gun. The regulator valve is located so as to act to close off the pipe upon the wand being disconnected from the spray gun.

Mounting plates are provided in longitudinally spaced relation to one another on the pipes. The plates are formed with flat surfaces which are oriented perpendicular to the longitudinal direction of the pipes.

First and second wand mounting brackets are attached to and extend from the robot arm. The brackets are positioned along a line parallel to the longitudinal axis of the arm and are spaced such that the plates may cooperate with the first and second brackets when the wand is positioned on the arm. In addition, each of the brackets is provided with a slot for slidably receiving the pipes when the wand is positioned on the robot arm.

A third mounting bracket is attached to and extends from the arm of the robot. The third bracket may be aligned with the first and second brackets and holds a second half of the quick disconnect fitting for cooperating with the first half of the quick disconnect fitting associated with the wand. The portion of the quick disconnect fitting on the third bracket is connected to a spray gun mounted on an end of the robot arm. The distance from the second half of the fitting mounted on the third bracket to the end of the robot arm opposite from the spray gun is preferably substantially equal to the distance from the first half of the fitting on the first pipe to the connection of the pipes with the first and second hoses.

A rack is provided for mounting a plurality of wands in spaced relation to one another and within the reach of the arm of the robot. The rack is provided with first and second holding fixtures for holding each of the wands. Each pair of first and second fixtures are oriented along a substantially vertical line and are positioned so as to engage the mounting plates when the wand is located on the rack. Each of the fixtures is formed as a substantially planar body having a slot which is sized to receive the pipes.

The rack further includes a pair of engagement fingers positioned above each of the first and second holding fixtures such that the fingers may engage a collar portion of the quick disconnect fitting for disconnecting the first and second halves of the fitting. The fingers are located such that upon a certain predetermined movement of the robot arm, the collar may be positioned beneath the fingers and upon upward movement of the fitting, the collar will move longitudinally to release the fitting.

The first and second rigid pipes of the preferred embodiment enable the paint spraying system of the present invention to control the movement of the hoses during a paint spraying operation. The pipes extend rearwardly to a pivot point of the robot arm, where a minimum amount of movement will occur during the spraying operation, and are connected to long flexible hoses which allow the robot arm to have the necessary freedom of movement required to spray a workpiece.

Thus, the wand structure of the present invention enables the passage means used for conveying the different paint colors to be individually detachably mounted on the robot arm and thereby eliminates the need to permanently attach a common supply hose to the robot arm in order to prevent the hoses from whipping into the workpiece being painted as the arm is moved during a spraying operation.

Other objects and advantages of the invention will be apparent from the following description, the accompanying drawings, and the appended claims.

DESCRIPTION OF THE PREFERRED EMBODIMENTS

Figure 1:
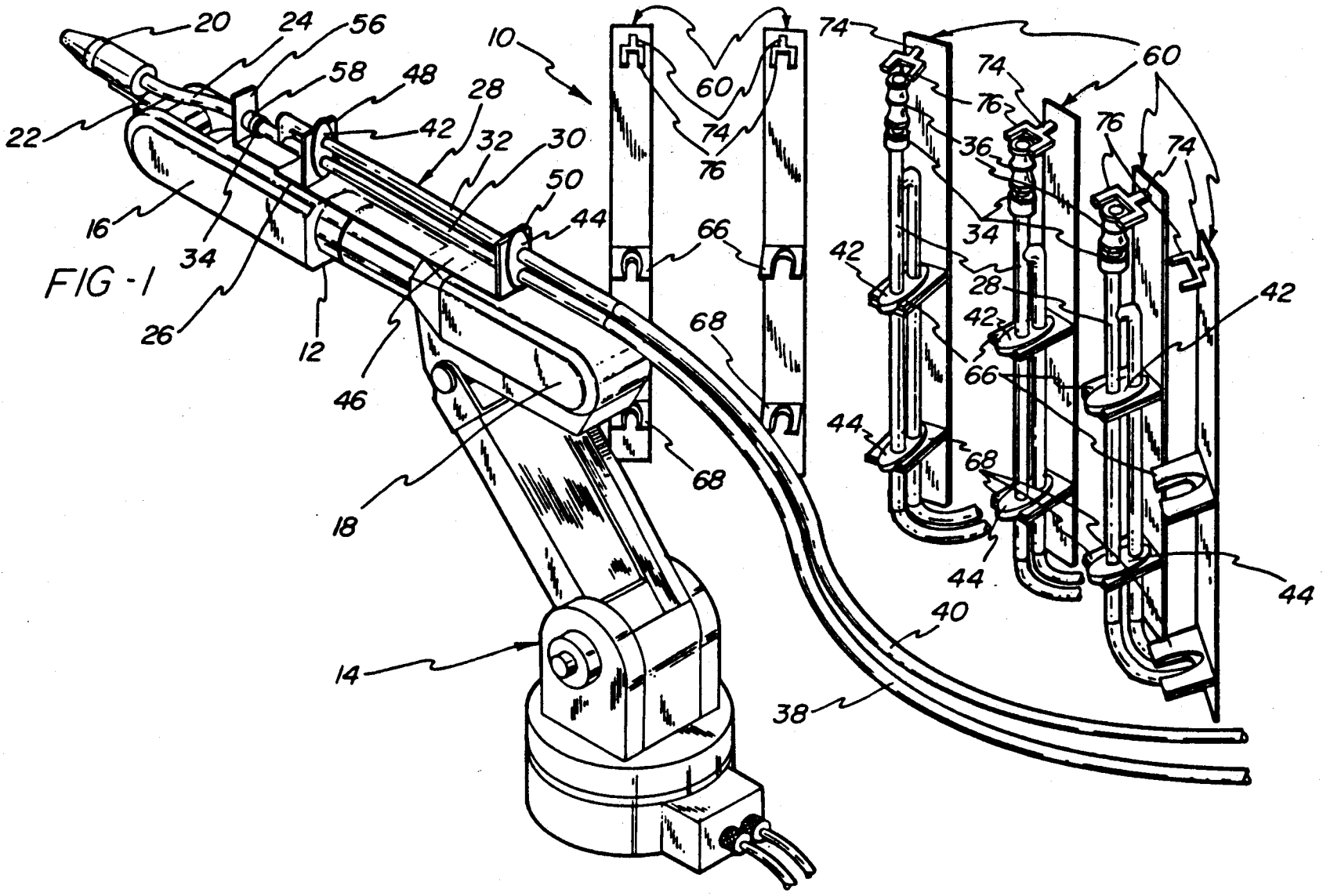
FIG. 1 is a perspective view of a painting system in accordance with a first embodiment of the present invention.

Referring to FIG. 1, a paint system, generally designated 10, is attached to an elongated arm 12 of a robot 14. The robot arm 12 includes a front freely movable end 16 and a second pivoted end 18.

A spray gun 20 is mounted to the free end 16 of the robot arm 12 by means of a pivotal connection 22. Paint is supplied to the gun 20 through a short flexible hose 24 which is permanently mounted to the robot arm 12 by means of a bracket assembly 26 attached to the robot arm 12. The bracket assembly 26 further holds a paint supply wand 28 which is connected to an end of the hose 24 opposite from the spray gun 20 for supplying paint to the hose 24.

Figure 2:
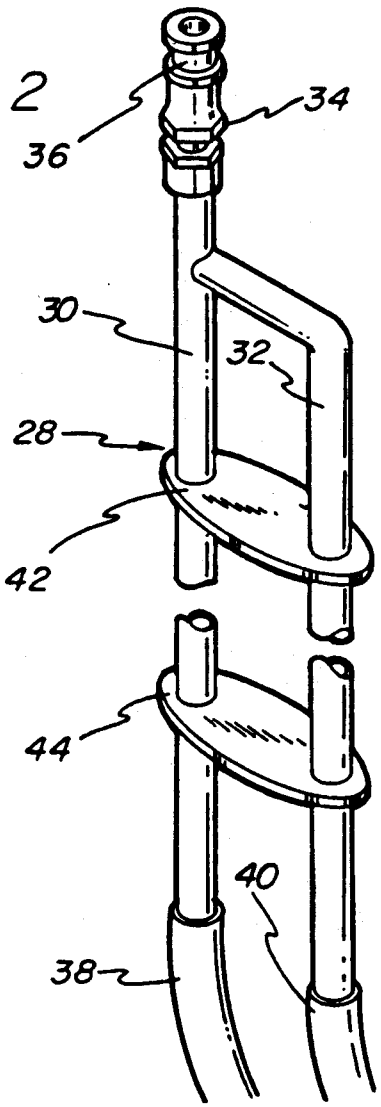
FIG. 2 is a perspective view of a wand in accordance with a first embodiment of the present invention.

As may be seen in FIG. 2, the wand 28 includes a first rigid pipe 30 and a second rigid pipe 32 oriented parallel to the first pipe 30. The pipe 30 acts as a passage means for the paint being supplied to the hose 24 and spray gun 20 and has a female first quick disconnect fitting portion 34 attached to one end thereof. The quick disconnect fitting may be of any conventional type and the one shown in FIG. 2 includes a spring biased movable collar 36 which may be moved longitudinally during connection and disconnection of the fitting 34 with a compatible male fitting portion. In addition, first fitting portion 34 may include a regulator valve for closing off the first pipe 30 when the fitting is not connected to the hose 24.

The first rigid pipe 30 is connected by means of a first flexible hose 38 to a paint supply line and the second rigid pipe 32 is connected by a second flexible hose 40 to a paint recirculation line such that when the regulator valve is closed, paint will continue to flow through pipe 30 and will be returned to the paint recirculation line through the second rigid pipe 32 and the second flexible hose 40.

The wand 28 further includes first and second elliptically shaped flat mounting plates 42, 44 which surround the first and second pipes 30, 32 and are oriented perpendicular to the longitudinal axis of the pipes. The mounting plates 42, 44 act to hold the pipes 30, 32 in parallel relation to each other and cooperate with the mounting bracket assembly 26 in holding the wand 28 on the robot arm 12.

Figure 3:
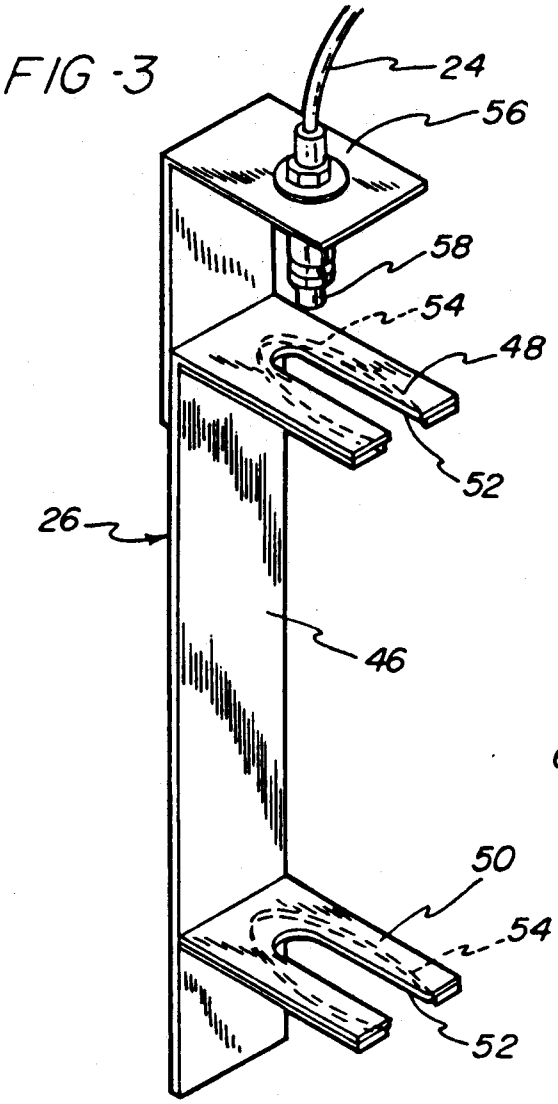
FIG. 3 is a perspective view of a bracket which may be mounted on the robot arm to hold a wand in accordance with a first embodiment of the present invention.

As can be seen in FIG. 3, the mounting bracket assembly 26 includes a base plate 46 and identical first and second wand mounting brackets 48, 50. Each of the brackets 48, 50 includes a slot 52 sized to receive the first and second pipes 30, 32 and an indented portion 54 which is sized to receive the first and second elliptical mounting plates 42, 44 such that the brackets 48, 50 will hold the wand 28 spaced from and adjacent to the robot arm 12.

In addition, the mounting bracket assembly 26 includes a third mounting bracket 56 for mounting a male second quick disconnect fitting portion 58 which is compatible with the first fitting portion 34. The hose 24 is connected to the second fitting portion 58 such that the hose 24 is immovably attached to the robot arm 12 by means of the bracket assembly 26 for conveying the paint to the spray gun 20.

A wand 28 may be positioned on the mounting bracket assembly 26 by inserting the pipes 30, 32 within the slots 52 of the first and second mounting brackets 48, 50 with the mounting plates 42, 44 positioned beneath respective mounting brackets 48, 50. The wand is then moved upward toward the third mounting bracket 56 such that the mounting plates 42, 44 engage in the portions 54 of the mounting brackets 48, 50 and the first fitting portion 34 is forced over the second fitting portion 58 to form a continuous fluid passage for the paint to flow to the spray gun 20.

Figure 4:
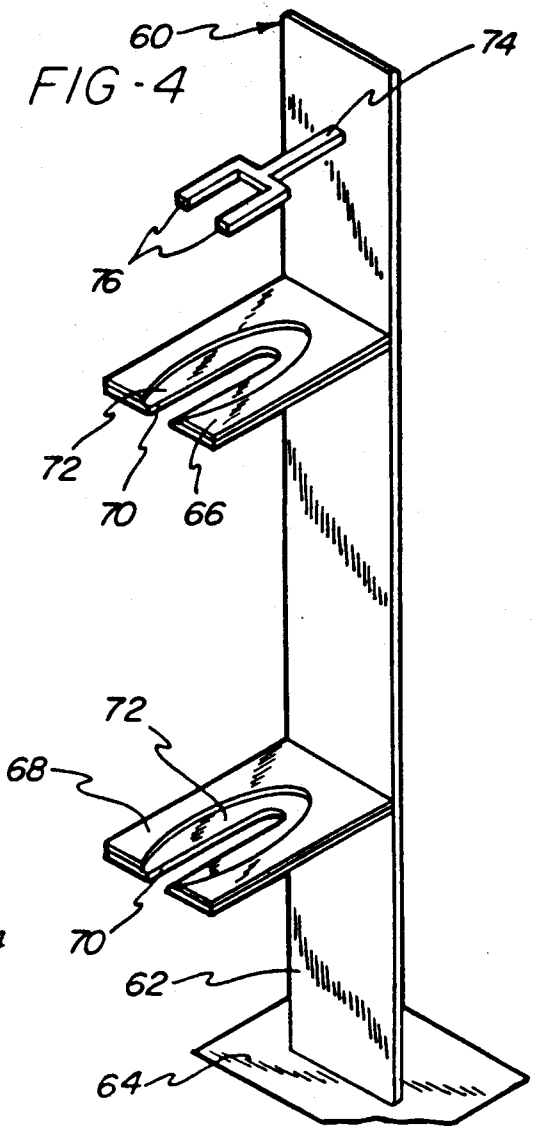
FIG. 4 is a perspective view of a rack for receiving and holding a wand in accordance with a first embodiment of the present invention.

Referring to FIG. 4, a rack 60 is provided for holding wands 28 which are not in use. The rack 60 includes a vertical support member 62 mounted on a horizontal base member 64 and is provided with first and second holding fixtures 66, 68 which are positioned along a substantially vertical line. The fixtures 66, 68 are formed with an identical structure to that of the mounting brackets 48, 50 and include slot portions 70 which are oriented to face toward the robot 14 and which are sized to receive the first and second pipes 30, 32. The fixtures 66, 68 further include indented elliptical portions 72 formed in a top portion thereof which surround the slots 70. The elliptical portions 72 are sized to receive the first and second mounting plates 42, 44.

An engaging means 74 is located above and aligned with the first and second fixtures 66, 68 and is provided with engaging fingers 76 extending away from the vertical support member 62. The engaging means 74 is positioned such that the fingers 76 will be located above the collar 36 of the first fitting portion 34 of a wand 28 positioned on the fixtures 66, 68. In addition, the fingers 76 are configured and positioned such that they may surround the second fitting portion 58 when the fitting portions 34, 58 are connected to each other with the wand 28 located on the rack 60.

It should be understood that although only one pair of fixtures 66, 68 is shown attached to the rack 60 in FIG. 4, the rack 60 may be constructed so as to hold a plurality of wands 28 with each wand 28 being provided with a pair of holding fixtures 66, 68, wherein the wands 28 are horizontally spaced along the rack 60 and positioned within reach of the robot arm 12 such that the robot may select from any one of the wands 28 positioned on the rack 60 (see FIG. 1).

The operation of a robot arm 12 picking up a wand 28 from a rack 60 will now be described with reference to FIGS. 5A–5C, in which a robot 14 is programmed by means of a control station (not shown) such that the robot arm 12 executes certain predetermined movements, as described below.

A robot arm 12 having a mounting bracket assembly 26 mounted thereto is first moved toward the rack 60 with the first and second mounting brackets 48, 50 positioned above the first and second mounting fixtures 66, 68, respectively. The third mounting bracket 56 is positioned above the engaging means 74 such that the second fitting portion 58 may move to a position between the fingers 76 and directly above and adjacent to the first fitting portion 34. In this position, the first and second pipes 30, 32 are located within the slots 52 of the brackets 48, 50 and the elliptical indentations 54 are aligned with the mounting plates 42, 44.

The robot arm 12 and bracket assembly 26 is then moved downwardly to engage the second fitting portion 58 within the first fitting portion 34 to couple the hose 24 and spray gun 20 to the wand 28. At the same time, the mounting plates 42, 44 are engaged within the indentations 54 to further support the wand 28 on the robot arm 12.

Figure 5C:
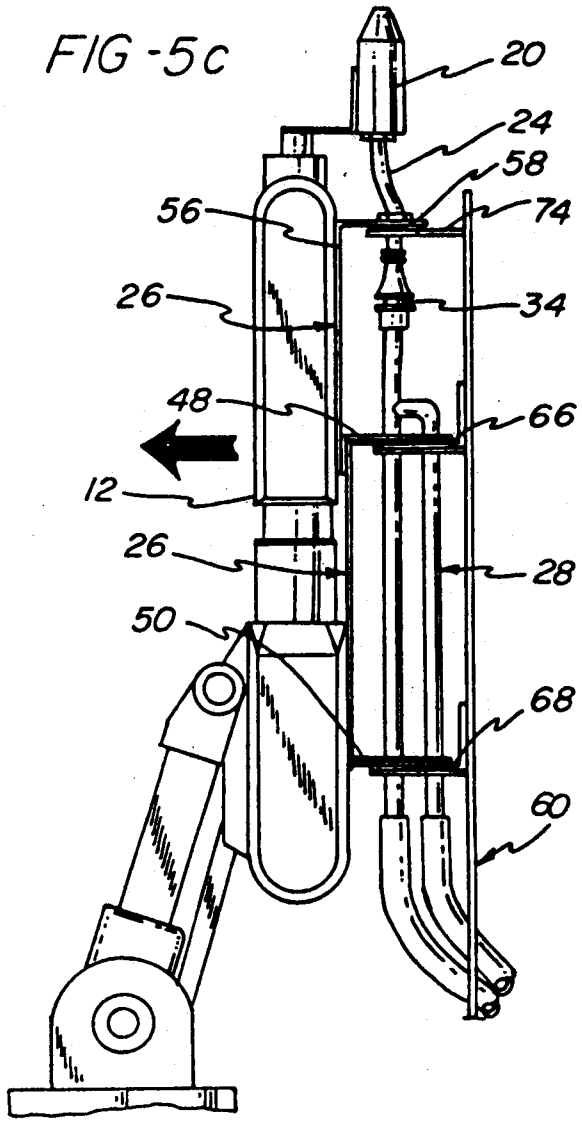
FIGS. 5A–5C show the steps of a robot arm picking up a wand from a rack in accordance with a first embodiment of the present invention.
Figure 5B:
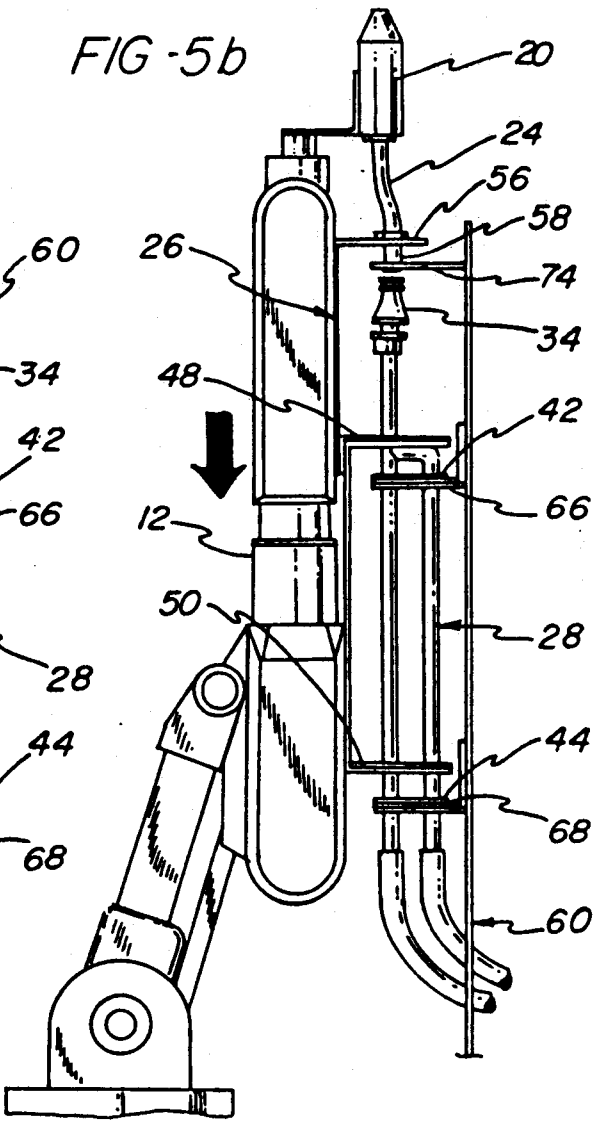
Figure 5A:
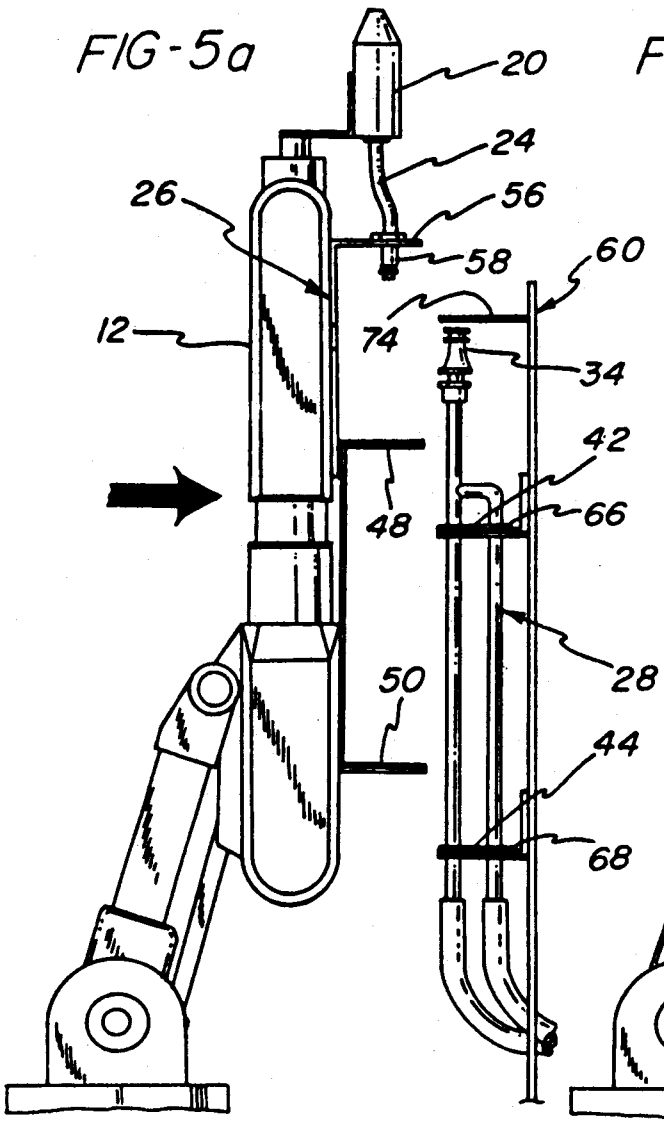

As can be seen in FIGS. 5B and 5C, the engaging means 74 is positioned low enough to allow the third bracket 56 and the second fitting portion 58 attached thereto to move downwardly without contacting the engaging means 74, while allowing the second fitting portion 58 to fully engage within the first fitting portion 34. After the first and second fitting portions 34, 58 are engaged with one another and the wand 28 is thus firmly engaged on the bracket assembly 26, the robot arm 12 is moved sideways to remove the wand 28 from the rack 60. The robot arm 12 may then be pivoted away from the rack 60 and toward a workpiece to be painted and a small amount of paint may be sprayed through the gun 20 to clean out any old paint of a different color prior to directing the gun 20 toward the workpiece.

In addition, the robot arm 14 may be mounted on means to convey the robot 14 sideways to move a short distance along a conveyor conveying the workpiece. The first and second flexible hoses 38, 40 may be formed of a length sufficient to accommodate the full extent of movement of the robot 14 and its arm 12 and, since the pipes 30, 32 move parallel to the arm 12 and extend to the pivot end 18 of the robot arm 12, the hoses 38, 40 will be maintained in a position behind the robot arm 12 during a paint spraying operation regardless of the length of the hoses 38, 40.

Figure 6C:
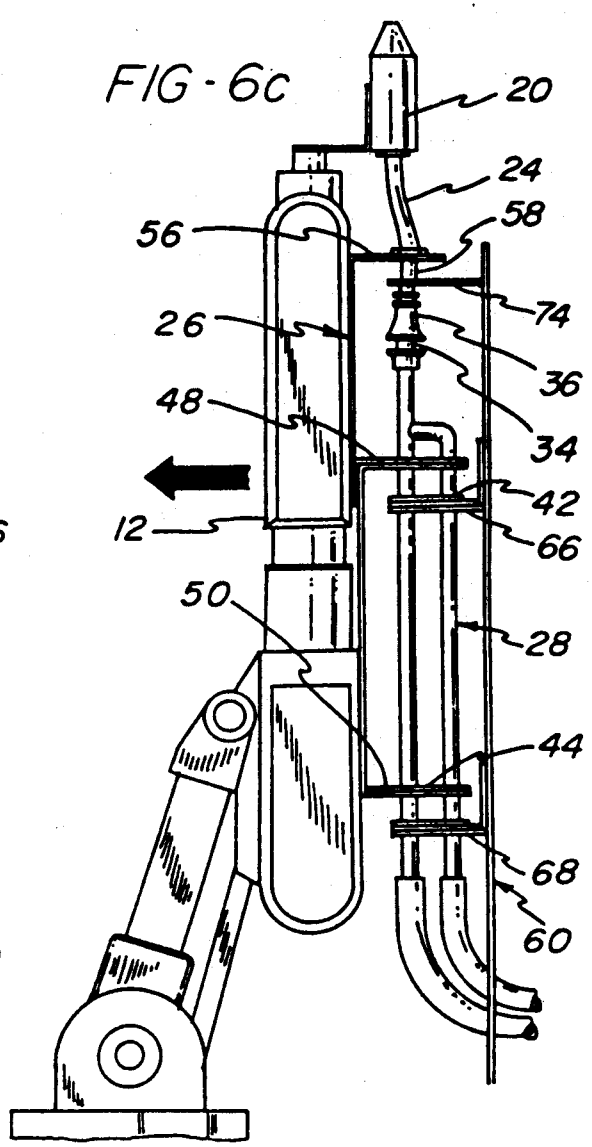
FIGS. 6A–6C show the steps of a robot arm placing a wand back in a rack in accordance with a first embodiment of the present invention.
Figure 6B:
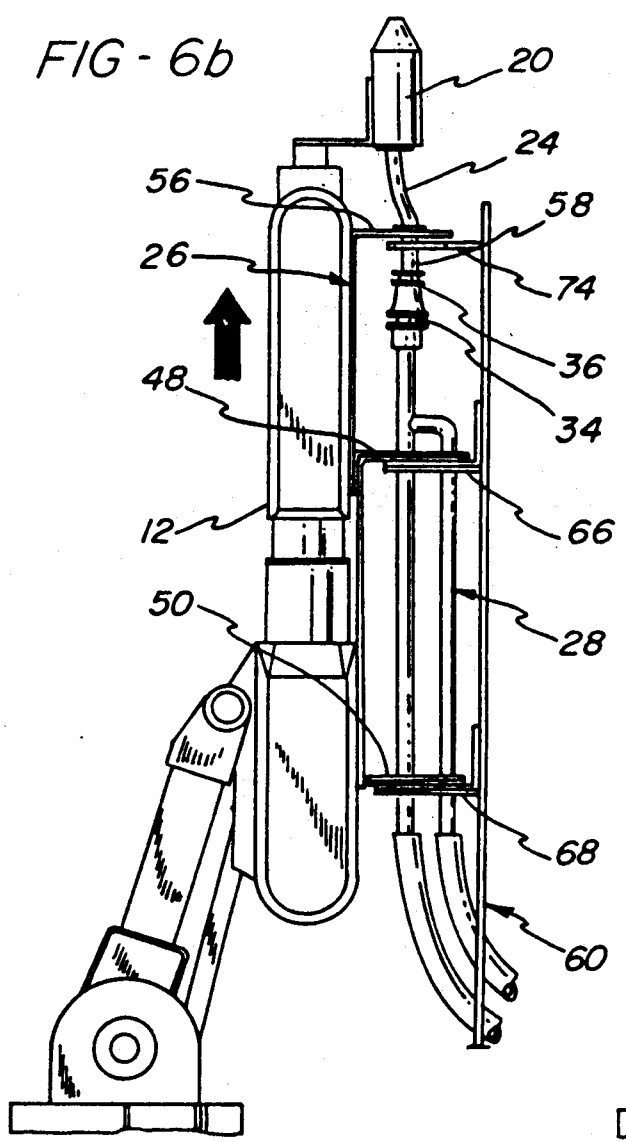
Figure 6A:
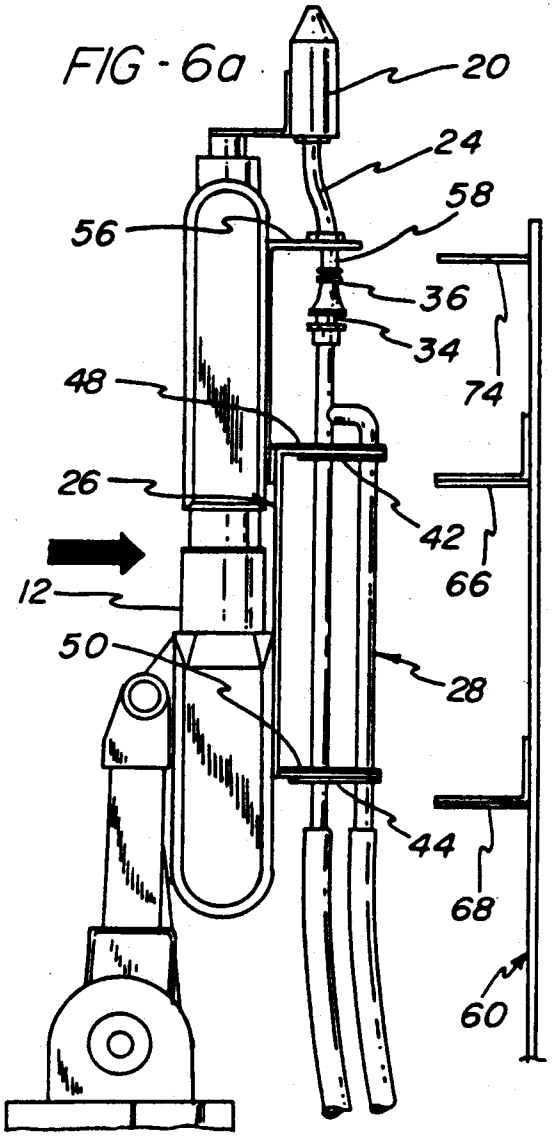

Referring to FIGS. 6A–6C, the movements of the robot arm 12 for transferring the wand 28 from the mounting bracket assembly 26 on the robot arm 12 to the rack 60 will be described. The robot arm 12 with the wand 28 attached thereto is first moved sideways toward the rack 60 with the first and second mounting brackets 48, 50 positioned slightly above the first and second fixtures 66, 68 such that the tubes 30, 32 may pass into the slots 70 on the fixtures 66, 68. In addition, the fingers 76 on the engaging means 74 will be positioned between the third mounting bracket 56 and the collar 36 on the first fitting portion 34.

When the first and second pipes 30, 32 are in position within the slots 70 formed in the first and second fixtures 66, 68 and with the fingers 76 of the engaging means 74 surrounding the second fitting portion 58, the robot arm 12 and wand 28 are moved upwardly, causing the collar 36 to contact the fingers 76 of the engaging means 74 such that the collar 36 is moved longitudinally downwardly relative to the wand 28 resulting in the first and second fitting portions 34, 58 disengaging from one another. Upon being disengaged, the wand drops down onto the rack 60 such that the mounting plates 42, 44 will rest in the indentations 72 formed in the first and second fixtures 66, 68. The robot arm 12 with its mounting bracket assembly 26 may then be moved sideways away from the rack 60 and rotated about a vertical pivot axis toward another wand 28 mounted on another pair of mounting fixtures 66, 68.

By causing the robot arm 12 to follow a series of predetermined movements such as those described above, a paint system may be provided whereby the robot arm 12 may select a particular color to be used during a spraying operation by moving to pick up a wand 28 corresponding to the particular color desired. Similarly, the wand 28 may be detached from the robot arm 12 by another series of movements such that the robot 14 may then be free to rotate around to a different wand 28 which may be attached thereto for the spraying of a different paint color.

Figure 7:
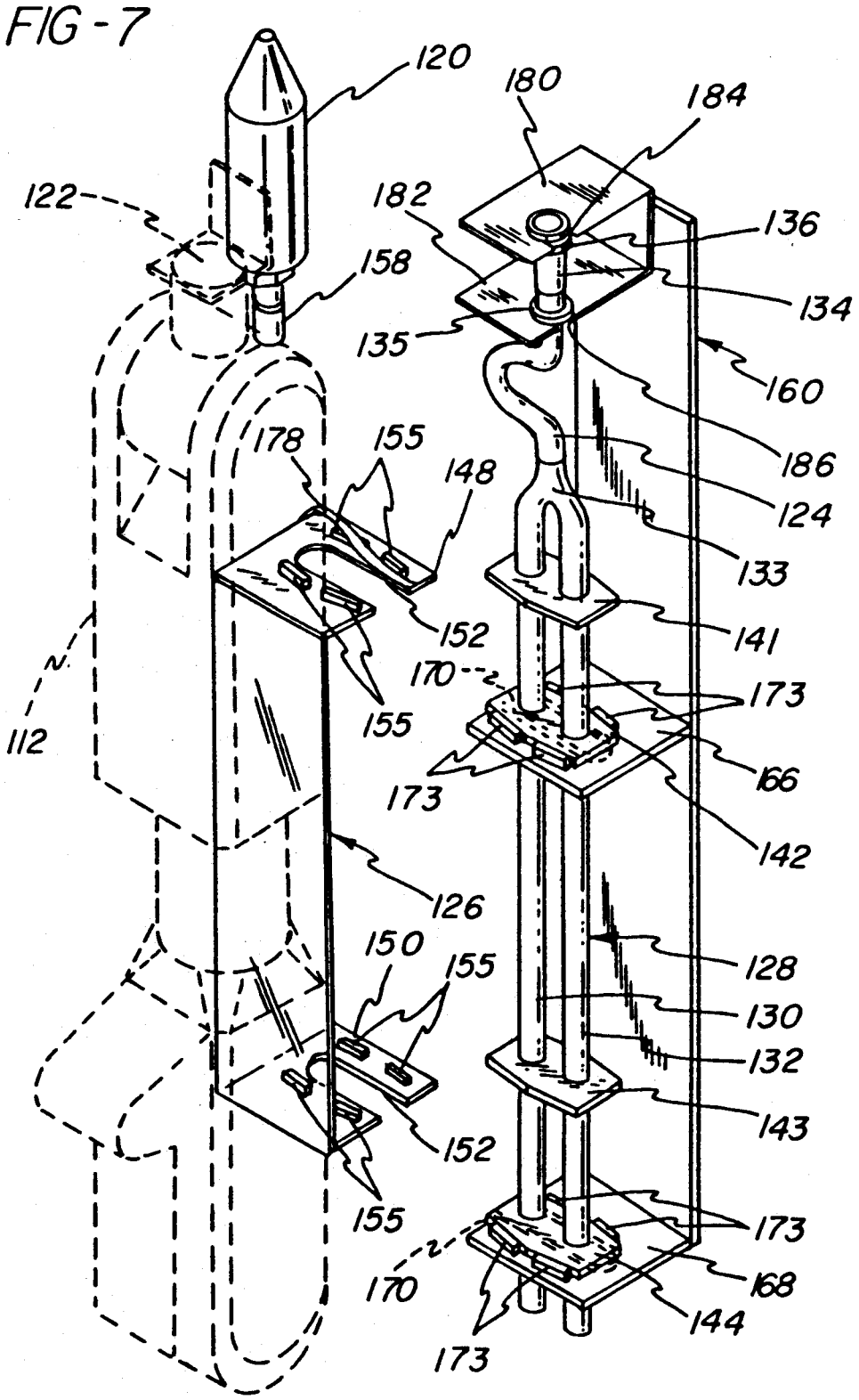
FIG. 7 is perspective view of a painting system in accordance with a second embodiment of the present invention.

A second embodiment of the present invention is shown in FIG. 7. In this embodiment the wand 128 is provided with first and second mounting plates 142, 144 for engaging first and second wand mounting brackets 166, 168 which are mounted to the rack 160, and third and fourth mounting plates 141, 143 are provided for engaging first and second mounting brackets 148, 150 attached to a bracket assembly 126 on the robot arm 112.

The mounting plates 141, 142, 143, 144 are formed with angled sides for engaging with guide blocks 155, 173 which are mounted on the mounting plates of the robot arm 112 and rack 160. In addition, the brackets 148, 150 are provided with slots 152, and brackets 166, 168 are provided with slots 170 similar to the slots of the previous embodiment such that when the wand 128 is received within the mounting brackets of the bracket assembly 126 or rack 160, the guide blocks 155, 173 will engage the angled sides of the wand mounting plates 141, 142, 143, 144 and thereby hold the wand 128 in place on the mounting brackets.

In this embodiment, the third and fourth mounting plates 141, 143 are provided in addition to the first and second mounting plates 142, 144 so that the mounting brackets 148, 150 located on the robot arm may engage the mounting plates 141, 143 from below during the operation of the robot arm 112 picking up the wand 128. In addition, a leaf spring clip 178 is positioned on a top portion of the mounting bracket 148 and extends from a corner thereof and over a portion of the slot 152 for forcing the mounting plate 141 down into engagement on the bracket 148 when the robot picks up the wand 128.

As in the previous embodiment, the wand 128 is provided with a first rigid paint supply pipe 130 and a second rigid paint recirculation pipe 132. The first and second pipes 130, 132 are connected at a Y-shaped junction 133 to which a flexible hose 124 is attached. The flexible hose 124 ends in a female first quick disconnect fitting portion 134 and includes a longitudinally movable collar 136 which operates in a manner similar to the collar of the previous embodiment to allow the first fitting portion 134 to be connected to and disconnected from a male second quick disconnect fitting portion 158 which is rigidly mounted adjacent to a spray gun 120 on an end of the robot arm 112.

First and second fitting holding plates 180, 182 are attached to the rack 160 above the mounting bracket 166 for holding the first quick disconnect fitting portion 134 when the wand 128 is mounted in the rack 160. The plates 180, 182 are provided with slots 184, 186, respectively, for receiving the fitting portion 134. The fitting portion 134 is provided with a washer 135 on a bottom portion thereof for engaging a top surface of the plate 182 and the plate 180 is located above the plate 182 at a distance which allows the collar 136 to slide along the bottom thereof.

In order to pick up a wand 128 from the rack 160, the robot arm 112 first positions the male fitting portion 158 over the female fitting portion 134 and moves downwardly until the male and female fitting portions are engaged and locked together. The robot arm 112 then moves the connected fitting sideways out of engagement with the slots 184 and 186. During the engagement of the fitting portions 134, 158 and removal of the fitting from the plates 180, 182, the mounting brackets 148, 150 on the robot arm remain out of engagement with the wand 128.

After the fitting portions 134, 158 are in engagement with one another, the robot arm 112 moves the mounting brackets 148, 150 toward the mounting plates 141, 143 on the wand 128 until the end of the clip 178 contacts the top of the mounting plate 141. The robot arm 112 then moves downwardly a small amount such that the mounting brackets 148, 150 are positioned below the mounting plates 141, 143, respectively, while maintaining the clip 178 in position over the mounting plate 141. The robot arm then moves sideways such that the first and second pipes 130, 132 are engaged within each slot 152 of the mounting brackets 148, 150, and the robot arm 112 is moved upwardly to engage the mounting brackets 148, 150 with the mounting plates 141, 143, respectively.

With the wand 128 engaged on the mounting brackets 148, 150 the robot lifts the wand 128 such that the plates 142, 144 clear the guide blocks 173 located on the mounting brackets 166, 168 and moves the wand 128 sideways to withdraw the wand 128 from the slot 170 in each of the mounting brackets 166, 168. It should be noted that the clip 178 acts to bias the wand 128 downwardly into engagement with the guide blocks 155 on the mounting brackets 148, 150 such that the wand 128 is held firmly in place during the painting operation.

In order to transfer the wand 128 from the robot arm 112 back to the rack 160, the robot arm 112 first positions the tubes 130, 132 of the wand 128 within the slots 170 of the mounting brackets 166, 168 on the rack 160. The robot arm 112 then moves downwardly placing the mounting plates 142, 144 between the guide blocks 173 of the mounting brackets 166, 168 and continues its downward movement until the mounting brackets 148, 150 on the robot arm 112 are disengaged from the mounting plates 141, 143 and the clip 178 is deflected upwardly. The robot arm 112 then moves away from the wand 128 such that the slots 152 of the mounting brackets 148, 150 are disengaged from the tubes 130, 132 of the wand 128.

The female fitting portion 134 is then disengaged from the male fitting portion 158 by engaging the fitting within the slots 184, 186 such that the washer 135 is located above the plate 182 and the collar 136 is located below the plate 180. The robot arm 112 is then moved upwardly such that the collar 136 is moved downwardly relative to the rest of the female fitting portion 134, thus causing the male fitting portion 158 to disengage from the female fitting portion 134 which is subsequently held in place on the rack 160 by the holding plates 180, 182.

Thus, it can be seen that the present embodiment incorporates a two-step operation to connect and disconnect the wand 128 to and from the robot arm 112. When it is desired to pick up the wand 128, the connector portions 134, 158 are first connected together and subsequently the mounting plates 141, 143 are engaged to remove the wand from the rack 160. When it is desired to replace the wand 128 in the rack 160 the mounting plates 142, 144 are first engaged with the rack 160 and then, with the wand 128 positioned in the rack 160, the fitting portions 134, 158 are disengaged from each other.

The above operations may be facilitated by mounting the spray gun 120 on a pivotal mount 122 at the end of the robot arm 112 which permits the gun 120 to be rotated about the longitudinal axis of the robot arm 112. Thus, the gun 120 and male fitting portion 158 may be located at the back of the robot arm 112 during engagement of the fitting portion 158 with fitting portion 134, and then may be pivoted to a position at the side of the robot arm 112 such that the gun 120 and fitting portions 134, 158 are out of the way as the bracket assembly 126 engages the mounting plates 141, 143. Similarly, the spray gun 120 and fitting portions 134, 158 may be positioned at the side of the robot arm 112 during the transfer of the wand 128 to the rack 160, and subsequently pivoted about the longitudinal axis of the robot arm 112 such that they are located at the back of the robot arm 112 during separation of the fitting portions 134, 158 from one another.

It should be apparent that the embodiment shown in FIG. 7 further facilitates reducing the amount of paint loss by incorporating the flexible tube 124 directly into the wand structure 128. The only paint loss which will occur with this arrangement will be the paint required to clean out the short paint passage from the male fitting portion 158 to the nozzle of the spray gun 120.

As can be seen from the above description, the present invention avoids the problem of the prior art painting systems in that a paint passage is provided for following the movements of the pivoted robot arm such that the paint passage lies parallel to the arm during its movement and extends from a point adjacent to a pivoted end of the arm toward a freely movable end of the arm whereby the flexible paint supply hoses for the spraying operation are prevented from swinging inwardly toward the workpiece being painted.

It should also be noted that the present invention is not limited to the embodiments shown for mounting the wand to the robot arm and for holding the wands in the rack. The wands may be positioned in any orientation which places them within reach of the robot arm and any convenient means for transferring the wands from a holding position onto the robot arm upon predetermined movements of the robot arm may be used.

Further, the wand need not necessarily be formed of two pipes and the second pipe may be eliminated such that the wand is formed by only the paint supply pipe.

The present invention provides a painting system which may be retrofit for use with existing robot arms such that the system may be economically incorporated into existing painting plants. Further, by providing a separate wand for each paint color, the problem of mixing different paint colors through the recirculatory system is prevented and thus costly down time is avoided. In addition, by avoiding lengthy connecting hoses between the spray gun and the paint supply hose, the amount of paint used for flushing the old paint color out of the paint passage to the spray gun is minimized.

While the forms of apparatus herein described constitute preferred embodiments of the invention, it is to be understood that the invention is not limited to these precise forms of apparatus, and that changes may be made therein without departing from the scope of the invention which is defined in the appended claims.

What is claimed is:

1. In combination with a robot having a movable arm, a spraying system comprising:

passage means for conveying a fluid to be sprayed to a first freely movable end of said arm; and attachment means for detachably holding said passage means on said arm such that said passage means extends from a point adjacent to a second pivoted end of said arm toward said first end of said arm and whereby said passage means is constrained from moving relative to said arm during a spraying operation;

said passage means being attachable to and detachable from said arm upon predetermined movements of said arm wherein, upon detachment of said passage means, said arm is separated from said passage means at said first and second ends of said arm.

2. The combination of claim 1 wherein said passage means includes a rigid portion which extends from a point adjacent to said second end of said arm toward said first end of said arm when said passage means is attached to said arm.

3. The combination of claim 2 wherein said passage means includes a first portion of a detachable fitting means, and said attachment means includes a second portion of said fitting means which may be attached to and detached from said first portion upon said predetermined movements of said arm.

4. The combination of claim 3 wherein said rigid portion of said passage means extends to said first portion of said fitting means.

5. The combination of claim 4 wherein said second portion of said fitting means is located adjacent to said first end of said arm.

6. The combination of claim 3 wherein rack means are provided for holding said passage means for attachment to said attachment means and for receiving said passage means when said passage means is detached from said arm upon said predetermined movements of said arm.

7. The combination of claim 6 wherein said rack means includes means for engaging said fitting means to cause said passage means to separate from said arm upon movement of said arm.

8. The combination of claim 3 wherein said attachment means includes bracket means mounted on said arm for engaging said rigid portion of said passage means and for holding said passage means in spaced relation adjacent to said arm.

9. The combination of claim 3 wherein a length of flexible hose extends between said rigid portion of said passage means and said first portion of said detachable fitting means.

10. In combination with a robot having a movable arm, a spraying system comprising:

passage means for conveying a fluid to be sprayed to a first freely movable end of said arm;

attachment means for detachably holding said passage means on said arm;

rack means for holding said passage means when said passage means is detached from said arm, said rack means being cooperable with said attachment means for attaching and detaching said passage means to and from said arm upon predetermined relative movements between said arm and said rack means; and said attachement means holding said passage means such that said passage means is adjacent to said arm from a point adjacent to said first end to a point adjacent to a second pivoted end of said arm, wherein said passage means includes a first portion of a detachable fitting means, and said attachment means includes a second portion of said fitting means mounted adjacent to said first end of said arm and which may be attached to and detached from said first portion upon said predetermined relative movements between said arm and said rack means.

11. The combination of claim 10 wherein said attachment means further includes bracket means located intermediate said first and second ends of said arm for holding said passage means adjacent to said arm.

12. The combination of claim 11 wherein said bracket means engage with and disengage from said passage means upon said predetermined relative movements between said arm and said rack means.

13. The combination of claim 10 wherein said rack includes engagement means for engaging said fitting to cause said first and second portions to disengage from each other upon relative movement between said arm and said rack means.

14. The combination of claim 13 wherein said passage means includes a rigid portion having a length substantially equal to the distance from said first portion of said fitting means to said second end of said arm.

15. The combination of claim 14 wherein said passage means includes a flexible hose attached to said rigid portion at an end of said rigid portion distal from said first portion of said fitting means.

16. The combination of claim 10 wherein said passage means includes a rigid portion and a flexible hose extending from said rigid portion to said first portion of said detachable fitting means.

17. In combination with a robot having a movable elongated arm, a paint spraying system comprising:

a plurality of paint wands for positioning on said arm of said robot, each of said wands including a first elongated rigid pipe for conveying paint, a second elongated rigid pipe connected to and oriented parallel to said first pipe for conveying paint from said first pipe, first and second flexible hoses connecting said first and second pipes to a paint source and a paint recirculation system, respectively, flat mounting plates attached to and surrounding said pipes in longitudinally spaced relation to one another, said plates being oriented perpendicular to said pipes, and a first half of a quick disconnect fitting connected to said first end of said first pipe;

first and second wand mounting brackets attached to and extending from said arm of said robot, said brackets being positioned along a line parallel to the longitudinal axis of said arm and located such that said plates may cooperate with said first and second brackets when said wand is positioned on said arm, and each bracket including a slot for receiving said pipes;

a third mounting bracket attached to and extending from said arm of said robot, said third bracket being mounted to align with said first and second brackets and holding a second half of said quick disconnect fitting which is compatible with said first half of said quick disconnect fitting, said first half of said fitting having a spring biased longitudinally movable collar for disconnecting said first and second halves of said fitting, and a third flexible hose for connecting said rigid pipes to a spray gun mounted to a first end of said arm when said first and second halves of said fitting are connected to each other;

a rack for mounting a plurality of said wands horizontally spaced from each other within the reach of said arm of said robot, said rack including first and second holding fixtures for each wand, said first and second fixtures being positioned along a substantially vertical line and being spaced from each other a distance substantially equal to the spacing between said mounting plates, each of said fixtures having a substantially planar body positioned in a substantially horizontal plane for receiving and supporting said mounting plates of said wand and including a slot sized to receive said pipes, and a pair of engagement fingers aligned with and positioned above each of said first and second holding fixtures for engaging said collar on said first half of said quick disconnect fitting such that upon positioning the collar of a wand located on said arm of said robot below and in contact with said fingers, said first and second halves of said quick disconnect fitting will be detached from each other upon upward movement of said wand.

18. A method of using a robot having a movable arm to spray a fluid, said arm including a first freely movable end and a second pivoted end, said method comprising:

providing passage means for conveying said fluid to be sprayed to said first freely movable end of said arm, said passage means being attachable to and detachable from said arm;

providing rack means for holding said passage means in spaced relation relative to said first and second ends of said arm;

moving said arm toward said rack means;

moving said arm relative to said passage means to thereby attach said passage means to said arm such that said passage means is constrained from moving relative to said arm between said first end and said second pivoted end of said arm; and moving said arm with said passage means attached thereto away from said rack means.

19. The method of claim 18 wherein said passage means includes an elongated rigid portion and said step of attaching said passage means includes positioning said rigid portion such that said rigid portion extends along said arm with an end thereof located adjacent to said second end of said arm.

20. The method of claim 19 wherein said passage means carries a first portion of a quick disconnect fitting and said arm carries a second portion of said fitting and said step of attaching said passage means includes moving said arm to engage said first portion with said second portion of said fitting.

21. The method of claim 20 wherein said rack means holds a plurality of passage means positioned for being selectively attached to said arm.

* * * * *